US007398607B1

(12) United States Patent
Garcia et al.

(10) Patent No.: US 7,398,607 B1
(45) Date of Patent: Jul. 15, 2008

(54) HEEL STRAP APPARATUS AND MOUNTING METHOD

(76) Inventors: Grace A. Garcia, 875 E. Camino Real, Apt. 5A, Boca Raton, FL (US) 33432; Michael E. Cummings, 875 E. Camino Real, Apt. 5A, Boca Raton, FL (US) 33432

( * ) Notice: Subject to any disclaimer, the term of this patent is extended or adjusted under 35 U.S.C. 154(b) by 0 days.

(21) Appl. No.: 11/585,292

(22) Filed: Oct. 23, 2006

Related U.S. Application Data

(60) Provisional application No. 60/755,526, filed on Dec. 31, 2005.

(51) Int. Cl.
*A43B 3/12* (2006.01)
*A43B 7/20* (2006.01)

(52) U.S. Cl. ..... 36/11.5; 36/89; 36/101

(58) Field of Classification Search ..... 36/11.5, 36/101, 89, 62, 72 B, 74
See application file for complete search history.

(56) References Cited

U.S. PATENT DOCUMENTS

| | | | | |
|---|---|---|---|---|
| 1,018,708 | A * | 2/1912 | Hetrick | 36/62 |
| 2,434,064 | A * | 1/1948 | Bredin | 2/22 |
| 2,651,117 | A * | 9/1953 | Harris | 36/112 |
| 3,570,147 | A * | 3/1971 | Chiu | 36/100 |
| 2006/0174514 | A1 * | 8/2006 | Scozzafava et al. | 36/11.5 |

* cited by examiner

*Primary Examiner*—Ted Kavanaugh
(74) *Attorney, Agent, or Firm*—Oltman, Flynn & Kubler

(57) ABSTRACT

A heel strap apparatus for securing the rear portion of a strapless shoe to the ankle of a wearer foot includes a linking strap segment having a linking strap segment first end and a linking strap segment second end, for wrapping around the back of a wearer heel; an ankle engaging portion extending from the linking strap segment for wrapping around the front of the wearer ankle to engage the ankle; and a shoe engaging portion extending from the linking strap segment for fitting around the bottom of the shoe to engage the shoe.

9 Claims, 4 Drawing Sheets

HEEL STRAP APPARATUS AND MOUNTING METHOD

FILING HISTORY

This application continues from provisional application Ser. No. 60/755,526, filed on Dec. 31, 2005.

BACKGROUND OF THE INVENTION

1. Field of the Invention

The present invention relates generally to the field of shoes and shoe accessories. More specifically the present invention relates to a heel strap apparatus for securing the rear portion of a strapless shoe to the ankle of a wearer foot to prevent the shoe from flapping against the heel of the wearer foot and to prevent a lower pant leg from becoming caught between the heel of the wearer foot and the shoe, the heel strap apparatus including a shoe engaging bottom loop for fitting around the bottom of a wearer shoe and a heel engaging back loop for fitting around the back of the heel of a wearer foot. The strap apparatus is provided in left and right hand configurations respectively for wearer left and right feet, and includes a substantially H-shaped strap harness including a linking strap segment defining the heel engaging back loop, having a linking strap segment first end and a linking strap segment second end, for wrapping around the back of a wearer ankle, an ankle engaging portion for wrapping around the front of the wearer ankle to engage the wearer ankle and a shoe engaging portion defining the shoe engaging bottom loop for wrapping around the bottom of the wearer shoe to engage the wearer shoe. The ankle engaging portion preferably includes an ankle strap segment extending from the linking strap segment first end for wrapping forwardly around the wearer ankle, and an ankle strap segment anchor structure extending from the linking strap segment second end including an ankle strap fastener for anchoring the free end of the ankle strap segment to secure the apparatus to the wearer ankle. The shoe engaging portion preferably includes a first shoe strap segment extending from the linking strap segment first end and a second shoe strap segment extending from the linking strap segment second end, and a shoe strap segment fastener for interconnecting free ends of the first and second shoe strap segments to secure the apparatus to the wearer shoe. The ankle strap segment and the first shoe strap segment preferably diverge in a Y-configuration from the linking strap segment first end, and the ankle strap segment anchor structure and the second shoe strap segment preferably diverge in a Y-configuration from the linking strap segment second end. A method of apparatus mounting is also provided.

It is believed that most wearers would prefer placement of the linking strap segment first end at the outward side of the wearer foot, and this requires the present left and right hand versions of the apparatus. The wearer, of course, has the option of interchanging the left and right hand versions to place the linking strap segment second ends at the outward sides of the wearer feet.

2. Description of the Prior Art

There have previously been heel a variety of shoe strap mechanisms. One such device is disclosed in Bricker, U.S. Pat. No. 6,651,359, issued on Nov. 25, 2003, the form of an interchangeable shoe strap system for altering the decorative look of a shoe. Ritter, et al., U.S. Pat. No. 6,772,541, issued on Aug. 10, 2004, teaches a footwear securement system for closed footwear which implements a strap having an X-configuration across the instep of the wearer foot. What is needed is a heel strap apparatus which provides a connection between the heel of a wearer foot and the heel of a strapless flat or high heel shoe, and holds them in abutting relation to prevent the shoe from slipping off the wearer foot, and providing the wearer with improved comfort while using strapless, heeled or flat shoes. Further, what is needed is a heel strap apparatus which is removable and portable, giving its wearer the option to wear strapless shoes as originally designated and, when additional comfort is desired, may be put on quickly and used without modification to the existing shoe.

It is thus an object of the present invention to provide a heel strap apparatus which secures the rear portion of an existing strapless shoe to the ankle of a wearer foot to hold the shoe against the foot and thereby prevent the shoe from flapping against the heel of the wearer foot and prevent a lower pant leg from becoming caught between the wearer heel and the shoe, and which is easily attachable and removable from an existing shoe without modification of the existing shoe.

It is another object of the present invention to provide such a heel strap apparatus which provides the wearer with enhanced comfort while using strapless flat or heeled shoes, and which helps prevent a strapless heeled shoe from slipping off the wearer foot when the wearer is performing daily activities such as walking, climbing stairs, dancing, running, jumping, and so forth.

It is still another object of the present invention to provide such a heel strap apparatus which, when the wearer has on long pants, prevents the lower portion of the pant leg or cuff from slipping between the wearer foot and the shoe.

It is finally an object of the present invention to provide such a heel strap apparatus which may be produced from a variety of materials having fashionable colors, and which optionally includes either permanent or removable decoration.

SUMMARY OF THE INVENTION

The present invention accomplishes the above-stated objectives, as well as others, as may be determined by a fair reading and interpretation of the entire specification.

A heel strap apparatus is provided for securing the rear portion of a strapless shoe to the ankle of a wearer foot, the apparatus including a linking strap segment having a linking strap segment first end and a linking strap segment second end and defining a heel engaging back loop, for wrapping around the back of a wearer heel; an ankle engaging portion extending from the linking strap segment for wrapping around the front of the wearer ankle to engage the ankle; and a shoe engaging portion extending from the linking strap segment for wrapping around the bottom of the shoe to engage the shoe defining a shoe engaging bottom loop.

The ankle engaging portion preferably includes an ankle strap segment having an ankle strap free end and extending from the linking strap segment first end for wrapping forwardly around the wearer ankle, and an ankle strap segment anchor structure extending from the linking strap segment second end and including an ankle strap fastener for anchoring the ankle strap segment free end to secure the apparatus to a wearer ankle. The shoe engaging portion preferably includes a first shoe strap segment extending from the linking strap segment first end and a second shoe strap segment extending from the linking strap segment second end, and a shoe strap segment fastener for interconnecting the first and second shoe strap segments to secure the apparatus to a wearer shoe.

A heel strap apparatus for securing the rear portion of a strapless shoe to the ankle of a wearer foot, the apparatus including a linking strap segment having a linking strap segment first end and a linking strap segment second end, for wrapping around the back of a wearer heel; an ankle engaging portion extending from the linking strap segment for wrapping around the front of the wearer ankle to engage the wearer ankle, the ankle engaging portion including an ankle strap segment having an ankle strap free end and extending from the linking strap segment first end for wrapping forwardly around the wearer ankle, and an ankle strap segment anchor structure extending from the linking strap segment second end and including an ankle strap fastener for anchoring the ankle strap segment free end to secure the apparatus to a wearer ankle; and a shoe engaging portion extending from the linking strap segment for wrapping around the bottom of the wearer shoe to engage the wearer shoe, the shoe engaging portion including a first shoe strap segment extending from the linking strap segment first end and a second shoe strap segment extending from the linking strap segment second end, and a shoe strap segment fastener for interconnecting the first and second shoe strap segments to secure the apparatus to a wearer shoe.

The ankle strap segment and the first shoe strap segment diverge from the linking strap segment first end in a Y-configuration, and the ankle strap segment anchor structure and the second shoe strap segment diverge from the linking strap segment second end in a Y-configuration. The ankle strap segment anchor structure has an ankle strap anchor structure outward end and where the ankle strap fastener includes a buckle mounted to the ankle strap segment anchor structure outward end through which the ankle strap segment is engagingly and removably fed.

The shoe strap segment fastener preferably includes a folded back and secured end loop at each the shoe strap segment free end and a linking ring mounted through one of the end loops, the linking ring having a break through which the other the end loop can be fitted to link the first shoe strap segment free end and the second shoe strap segment free end together, the linking ring permitting the first shoe strap segment and the second shoe strap segment to slide and rotate about the linking ring to different angles relative to each other to adjust to the ankle geometry of a wearer. The linking ring optionally is formed of a transparent plastic. The strap harness may be formed of one of: leather, cloth and vinyl, and optionally is formed of a transparent material.

A method for securing the above heel strap apparatus includes the steps of: placing the linking strap segment behind the back of the wearer ankle; wrapping the ankle strap segment around the front of the wearer ankle; securing the ankle strap segment free end to the ankle strap anchor structure, thereby securing the apparatus to a wearer ankle; wrapping the first and second shoe strap segments around the bottom of the wearer shoe; and interconnecting the first and second shoe strap segments with the shoe strap segment fastener to secure the apparatus to the wearer shoe.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
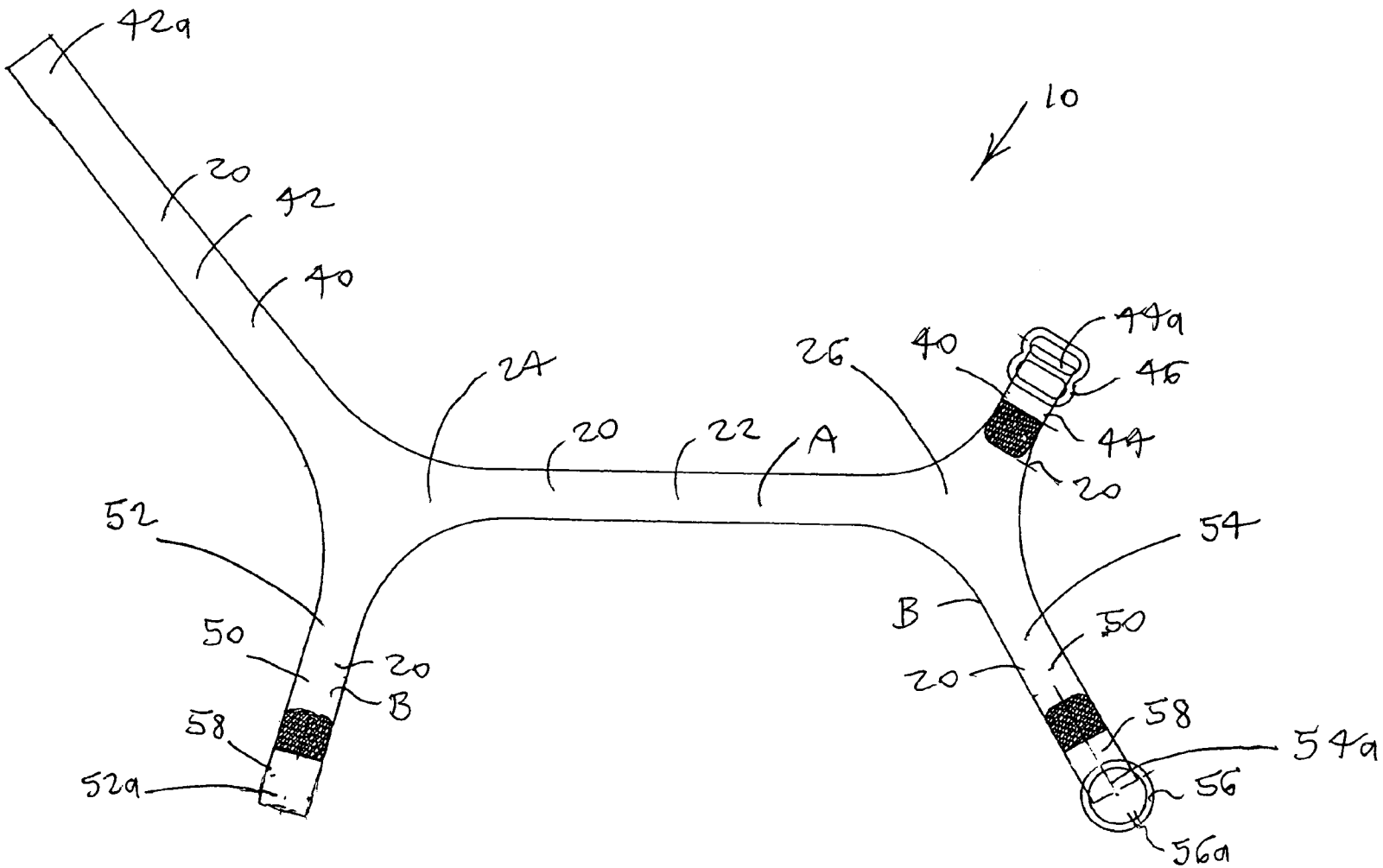
FIG. 1 is a plan view of the right hand version of the heel strap apparatus.
Figure 2:
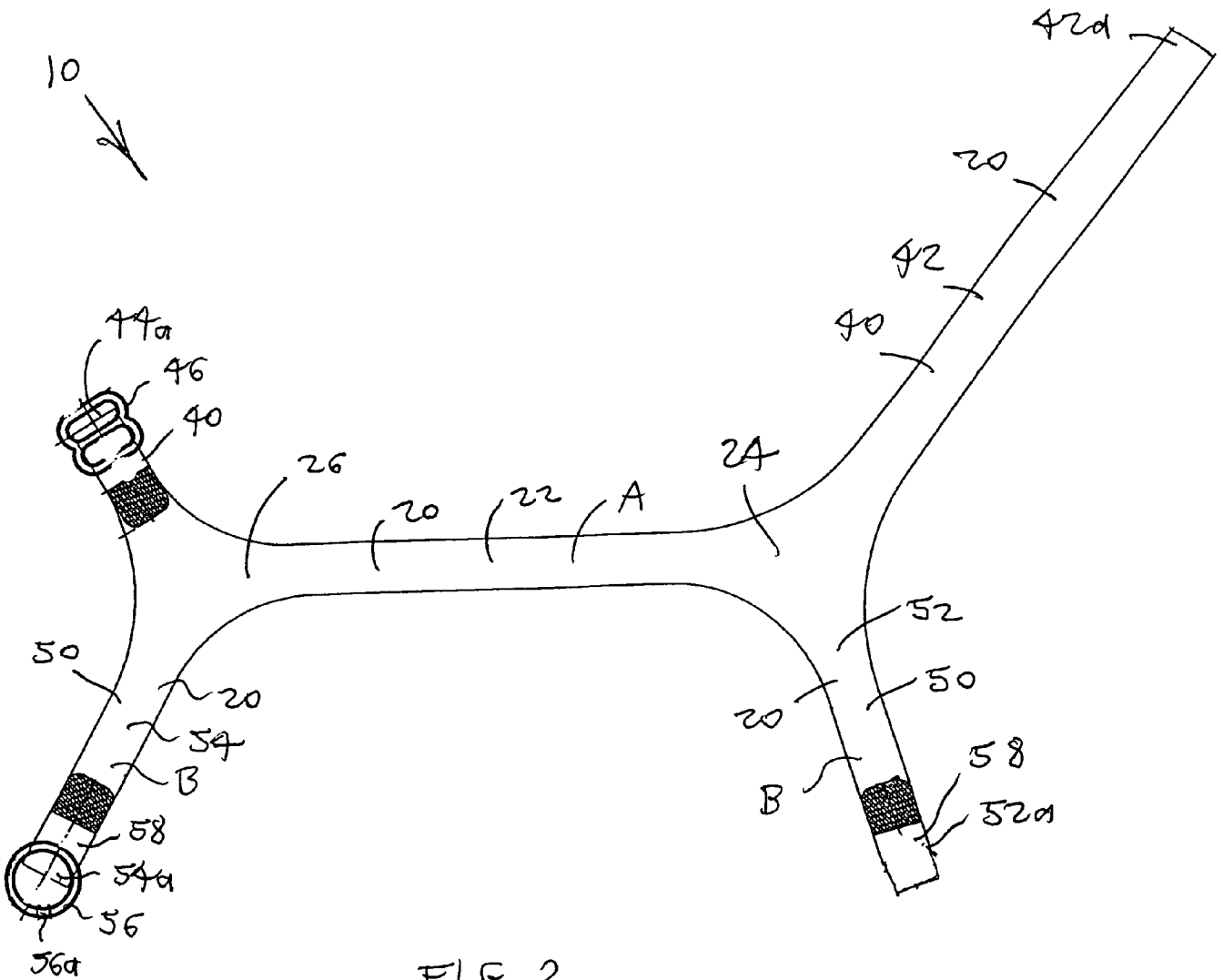
FIG. 2 is a plan view of the left hand version of the heel strap apparatus.
Figure 3:
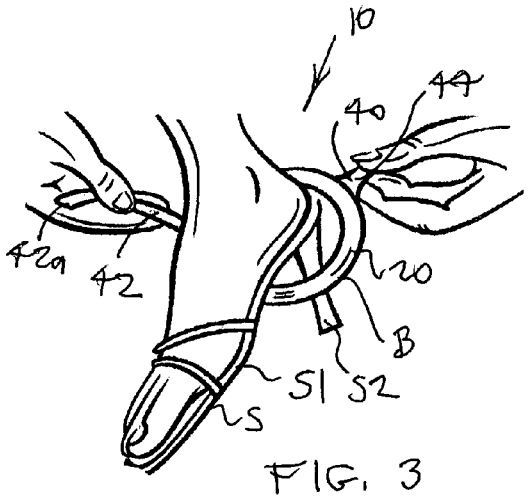
FIG. 3 is a perspective view of a wearer foot fitted into an open shoe, showing the linking strap segment of the present apparatus being fitted against the back of the wearer ankle and around the heel of the wearer shoe.
Figure 4:
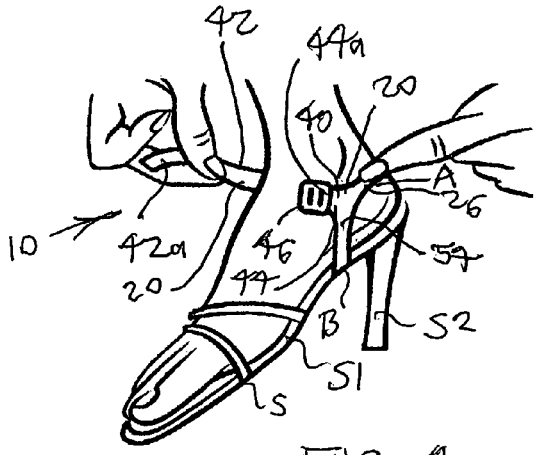
FIG. 4 is a view as in FIG. 3 showing the next stage of apparatus mounting in which the ankle strap segment is being extended around the front of the wearer ankle.
Figure 5:
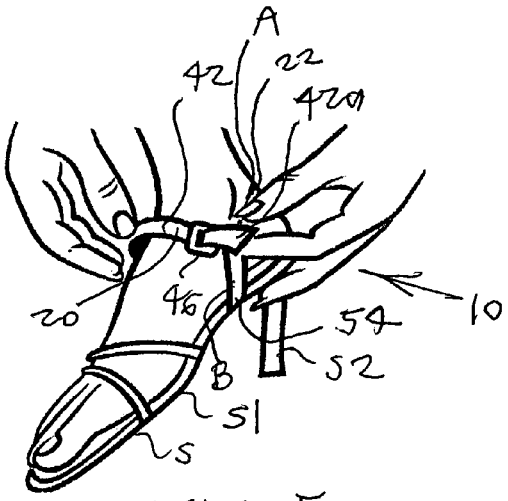
FIG. 5 is a view as in FIG. 4 showing the next stage of apparatus mounting in which the ankle strap segment free end is being fitted through the buckle of the strap segment anchor structure.
Figure 6:
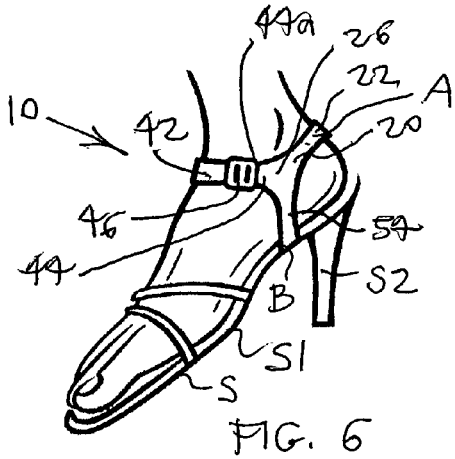
FIG. 6 is a view as in FIG. 5 showing the next stage of apparatus mounting in which the ankle strap segment is secured through the buckle of the strap segment anchor structure.
Figure 7:
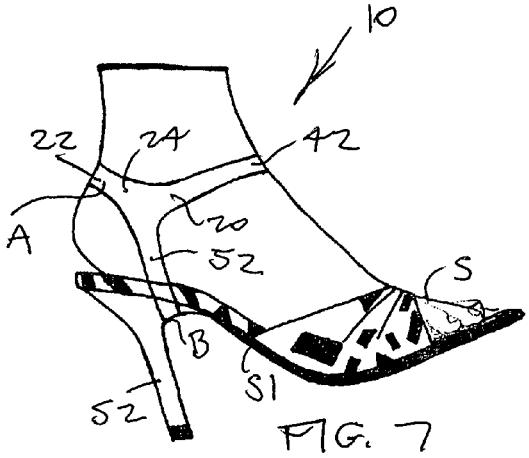
FIG. 7 is an outward side view of a wearer foot and shoe on which the present apparatus is installed.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1-12, an aftermarket heel strap apparatus 10 is disclosed for securing the rear portion of an existing strapless shoe S to the ankle ANK of a wearer foot F to prevent the shoe S from flapping against the heel H of the wearer foot F and to prevent a lower pant leg PL from becoming caught between the wearer foot heel and shoe S. Apparatus 10 is provided in left and right hand configurations respectively for wearer left and right feet, although a left hand configuration can be turned inside out to become a right hand configuration, and a right hand configuration can be turned inside out to become a left hand configuration, so that two of either the left or right hand configuration may be used rather than one of each. Apparatus 10 includes a substantially H-shaped strap harness 20 including a linking strap segment 22 defining a heel H engaging back loop A, having a linking strap segment first end 24 and a linking strap segment second end 26, for wrapping around the back of a wearer ankle ANK, an ankle engaging portion 40 for wrapping around the front of the wearer ankle ANK to engage the wearer ankle ANK and a shoe engaging portion 50 defining a shoe engaging bottom loop B for wrapping around the shoe bottom S1 of the wearer shoe S to engage the wearer shoe S forward of the shoe heel S2. The ankle engaging portion 40 preferably includes an ankle strap segment 42 having an ankle strap segment free end 42*a* and extending from the linking strap segment first end 24 for wrapping forwardly around the wearer ankle ANK, and an ankle strap segment anchor structure 44 having an ankle strap anchor structure outward end 44*a* and extending from the linking strap segment second end 26 and including an ankle strap fastener 46 for anchoring the ankle strap segment free end 42*a* to secure apparatus 10 to the wearer ankle ANK. The shoe engaging portion 50 preferably includes a first shoe strap segment 52 having a first shoe strap segment free end 52*a* and extending from the linking strap segment first end 24 and a second shoe strap segment 54 and having a second shoe strap free end 54*a* and extending from the linking strap segment second end 26, a shoe strap segment fastener for interconnecting free ends of the first and second shoe strap segments 52 and 54, respectively, to secure apparatus 10 to the wearer shoe S. The ankle strap segment 42 and the first shoe strap segment 52 preferably diverge in a Y-configuration from the linking strap segment first end 24, and the ankle strap segment anchor structure 44 and the second shoe strap segment 54 preferably diverge in a Y-configuration from the linking strap segment second end 26.

It is believed that most wearers would prefer placement of the linking strap segment first end 24 at the outward side of the wearer foot, and this requires the present left and right hand versions of apparatus 10. The wearer, of course, has the option of the switching the left and right hand versions to place the linking strap segment second ends 26 at the outward sides of the wearer feet.

The ankle strap fastener 46 preferably is an adjustable buckle 46 mounted to the ankle strap segment anchor structure outward end 44*a* through which the ankle strap segment 42 is removably fed and engaged. Alternatively the ankle strap fastener 46 may be a wide variety of other fasteners or fastening means, including but not limited to an elastic interconnecting segment, and hook and loop fasteners, preferably selected to permit automatic or manual adjustment between the shoes sole and the wearer ankle ANK.

The shoe strap segment fastener 56 preferably includes a folded back and secured shoe strap end loop 58 at each shoe strap segment free end 52*a* and 54*a* and a linking ring 56 mounted through the shoe strap end loops 58, preferably during shoe S manufacture for permanent fastening. The linking ring optionally has a break 56*a* through which the other shoe strap end loop 58 can be fitted to link the first and second shoe strap segment free ends 52*a* and 54*a* together after shoe strap end loops are formed. The linking ring 56 permits the first and second shoe strap segments 52 and 54 to slide and rotate about the linking ring 56 to different angles relative to each other to adjust to the ankle geometry of the particular wearer. The folded over shoe strap segment free ends 52*a* and 54*a* forming the shoe strap end loops 58 preferably are each welded or sewed to the remainder of shoe strap segment 52 or 54.

Figure 8:
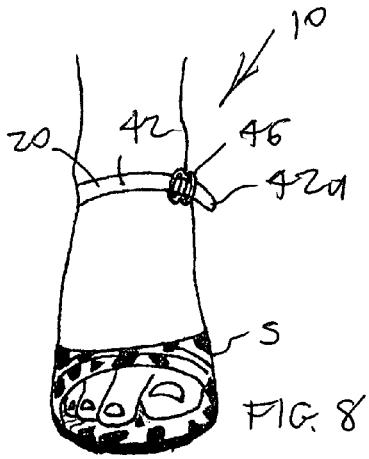
FIG. 8 is a front view of the foot, shoe and apparatus shown in FIG. 7.
Figure 9:
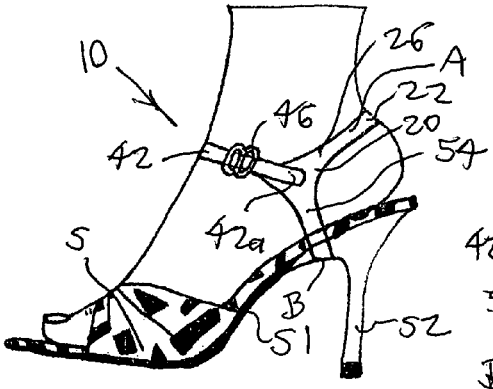
FIG. 9 is an inward side view of the foot, shoe and apparatus shown in FIG. 7.
Figure 10:
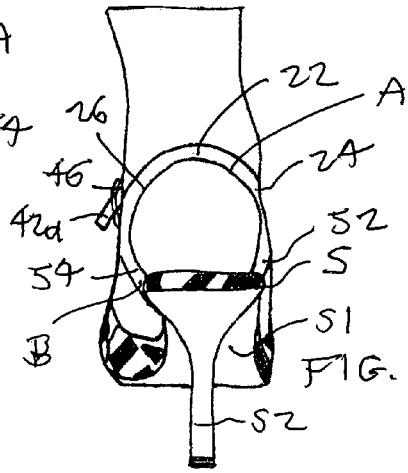
FIG. 10 is a rear view of the foot, shoe and apparatus shown in FIG. 7.
Figure 11:
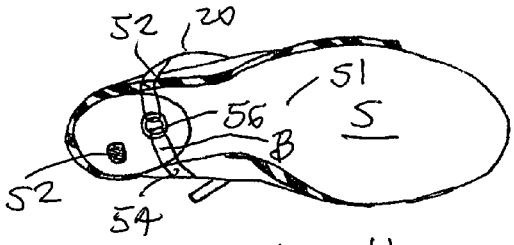
FIG. 11 is a bottom view of the foot, shoe and apparatus shown in FIG. 7.
Figure 12:
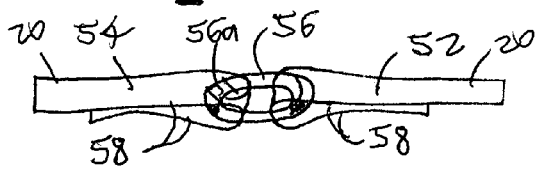
FIG. 12 is broken away close-up of free ends of the first and second shoe strap segments, shoe strap end loops and optional linking ring interconnecting the shoe strap end loops of the first and second shoe strap segments.

The plastic linking ring 56 may be formed of clear plastic as shown in FIG. 12, at section AA. The linking ring 56 is optional and may be eliminated during manufacture by connecting shoe strap segment free ends 52*a* and 54*a*, such as by welding or other means to become one continuous piece. As shown in FIG. 8, the buckle 46 is attached to the ankle strap segment anchor structure 44 by folding the its outward end 44*a* back through a loop portion of the buckle 46 and over the remainder of the ankle strap anchor structure 44, where it is preferably welded or sewn. Contemplated alternatives to the buckle 46 include snaps, rivets, magnets, quick release closures, hooks, elastic straps, sewn connections, chemical bonds, heat bonding or use of a combination buckles and/or hook and loop fasteners.

Other contemplated variations of parts of the heel strap apparatus 10 and apparatus 10 uses include the following. The strap harness 20 of the apparatus 10 may be formed of leather, cloth, vinyl, thermoplastic or any other material which provides sufficient tensile strength to secure the wearer heel to a strapless shoe S. The apparatus 10 may be used with strapless closed or open shoes S, sandals, flats, high heels, pumps, and other types of shoes. The heel strap apparatus 10 may be formed of transparent material to conceal it from view or from translucent or opaque materials having any of a variety of colors, providing the wearer with the option of mixing and matching the apparatus 10 color with different shoe S and clothing color schemes.

Preferred Method of Apparatus Mounting

A method for securing the heel strap apparatus 10 to the ankle ANK of a wearer foot and to a wearer shoe S on the wearer foot, includes the steps of: placing the linking strap segment 22 behind the back of the wearer ankle ANK; wrapping the ankle strap segment 42 around the front of the wearer ankle ANK; securing the ankle strap segment free end 42*a* to the ankle strap segment anchor structure 44, thereby securing the apparatus 10 to a wearer ankle ANK; wrapping the first and second shoe strap segments 52 and 54 around the bottom of the wearer shoe S; and interconnecting the first and second shoe strap segments 52 and 54 with the shoe strap segment fastener 56 to secure the apparatus 10 to the wearer shoe S. See FIGS. 3-6.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A heel strap apparatus for securing the rear portion of a strapless shoe to the ankle of a wearer foot, the apparatus comprising:

a linking strap segment having a linking strap segment first end and a linking strap segment second end defining a heel engaging back loop, for fitting around the back of a wearer heel;

an ankle engaging portion extending from said linking strap segment for wrapping around the front of the wearer ankle to engage the wearer ankle;

and a shoe engaging portion extending from said linking strap segment for fitting around the bottom of the wearer shoe to engage the wearer shoe;

wherein said ankle engaging portion comprises an ankle strap segment having an ankle strap free end and extending from said linking strap segment first end for wrapping forwardly around the wearer ankle, and an ankle strap segment anchor structure extending from said linking strap segment second end and comprising an ankle strap fastener for anchoring said ankle strap segment free end to secure said apparatus to a wearer ankle;

wherein said shoe engaging portion comprises a shoe engaging bottom loop, wherein said shoe engaging bottom loop comprises a first shoe strap segment extending from said linking strap segment first end and a second shoe strap segment extending from said linking strap segment second end, and a shoe strap segment fastener for interconnecting said first and second shoe strap segments to secure said apparatus to a wearer shoe; and wherein said ankle strap segment and said first shoe strap segment diverge from said linking strap segment first end in a Y-configuration, and said ankle strap segment anchor structure and said second shoe strap segment diverge from said linking strap segment second end in a Y-configuration.

2. A heel strap apparatus for securing the rear portion of a strapless shoe to the ankle of a wearer foot, the apparatus comprising:

a linking strap segment having a linking strap segment first end and a linking strap segment second end, for fitting around the back of a wearer heel;

an ankle engaging portion extending from said linking strap segment for wrapping around the front of the wearer ankle to engage the wearer ankle, said ankle engaging portion comprising an ankle strap segment having an ankle strap free end and extending from said linking strap segment first end for wrapping forwardly around the wearer ankle, and an ankle strap segment anchor structure extending from said linking strap segment second end and comprising an ankle strap fastener for anchoring said ankle strap segment free end to secure said apparatus to a wearer ankle;

and a shoe engaging portion extending from said linking strap segment for fitting around the bottom of the wearer shoe to engage the wearer shoe, said shoe engaging portion comprising a first shoe strap segment extending from said linking strap segment first end and a second shoe strap segment extending from said linking strap segment second end, and a shoe strap segment fastener for interconnecting said first and second shoe strap segments to secure said apparatus to a wearer shoe, said shoe engaging portion defining a shoe engaging bottom loop;

wherein said ankle strap segment and said first shoe strap segment diverge from said linking strap segment first end in a Y-configuration, and said ankle strap segment anchor structure and said second shoe strap segment diverge from said linking strap segment second end in a Y-configuration.

3. The heel strap apparatus of claim 2, wherein said ankle strap segment anchor structure has an ankle strap anchor structure outward end and wherein said ankle strap fastener comprises a buckle mounted to said ankle strap segment anchor structure outward end through which said ankle strap segment is engagingly and removably fed.

4. The heel strap apparatus of claim 2, wherein said shoe strap segment fastener comprises a folded back and secured end loop at each said shoe strap segment free end and a linking ring mounted through one of said end loops, said linking ring permitting said first shoe strap segment and said second shoe strap segment to slide and rotate about said linking ring to different angles relative to each other to adjust to the ankle geometry of a particular wearer.

5. The heel strap apparatus of claim 4, wherein said linking ring is formed of a transparent plastic.

6. The heel strap apparatus of claim 2, wherein said strap harness is formed of one of: leather, cloth and vinyl.

7. The heel strap apparatus of claim 2, wherein said strap harness is formed of a transparent material.

8. A heel strap apparatus for securing the rear portion of a strapless shoe to the ankle of a wearer foot, the apparatus comprising:

a linking strap segment having a linking strap segment first end and a linking strap segment second end, for fitting around the back of a wearer heel;

an ankle engaging portion extending from said linking strap segment for wrapping around the front of the wearer ankle to engage the wearer ankle, said ankle engaging portion comprising an ankle strap segment having an ankle strap free end and extending from said linking strap segment first end for wrapping forwardly around the wearer ankle, and an ankle strap segment anchor structure extending from said linking strap segment second end and comprising an ankle strap fastener for anchoring said ankle strap segment free end to secure said apparatus to a wearer ankle;

and a shoe engaging portion extending from said linking strap segment for fitting around the bottom of the wearer shoe to engage the wearer shoe, said shoe engaging portion comprising a first shoe strap segment extending from said linking strap segment first end and a second shoe strap segment extending from said linking strap segment second end, said first shoe strap segment and said second shoe strap segment being of substantially equal length to meet underneath a shoe sole, and a shoe strap segment fastener for interconnecting said first and second shoe strap segments to secure said apparatus to a wearer shoe, said shoe engaging portion defining a shoe engaging bottom loop;

wherein said shoe strap segment fastener comprises a folded back and secured end loop at each said shoe strap segment free end and a linking ring mounted through one of said end loops, said linking ring permitting said first shoe strap segment and said second shoe strap segment to slide and rotate about said linking ring to different angles relative to each other to adjust to the ankle geometry of a particular wearer.

9. The heel strap apparatus of claim 8, wherein said linking ring comprises a break through which an opposing said end loop can be fitted to link said first shoe strap segment free end to said second shoe strap segment free end.

* * * * *